US009320415B2

(12) United States Patent
Rosenbauer

(10) Patent No.: US 9,320,415 B2
(45) Date of Patent: Apr. 26, 2016

(54) METHOD AND DEVICE FOR TREATING OBJECTS WITH AT LEAST ONE TREATMENT AGENT IN A HOUSEHOLD DEVICE, SAID HOUSEHOLD DEVICE, ASSOCIATED PACKAGING AND A DOSING DEVICE

(71) Applicant: BSH Bosch und Siemens Hausgeräte GmbH, Munich (DE)

(72) Inventor: Michael Georg Rosenbauer, Reimlingen (DE)

(73) Assignee: BSH Hausgeraete GmbH, Munich (DE)

( * ) Notice: Subject to any disclaimer, the term of this patent is extended or adjusted under 35 U.S.C. 154(b) by 463 days.

(21) Appl. No.: 13/856,449

(22) Filed: Apr. 4, 2013

(65) Prior Publication Data

US 2013/0248404 A1 Sep. 26, 2013

Related U.S. Application Data

(62) Division of application No. 13/537,094, filed on Jun. 29, 2012, now Pat. No. 8,438,882, which is a division of application No. 10/539,994, filed as application No. PCT/EP03/13660 on Dec. 3, 2003, now Pat. No. 8,268,083.

(30) Foreign Application Priority Data

Dec. 20, 2002 (DE) ..... 102 60 144

(51) Int. Cl.

| | |
|---|---|
| ***B08B 3/00*** | (2006.01) |
| ***A47L 15/44*** | (2006.01) |
| ***A47L 15/00*** | (2006.01) |

(Continued)

(52) U.S. Cl.

CPC ..... *A47L 15/44* (2013.01); *A47L 15/006* (2013.01); *A47L 15/4454* (2013.01); *D06F 39/005* (2013.01); *D06F 39/02* (2013.01); *D06F 39/024* (2013.01)

(58) Field of Classification Search

None

See application file for complete search history.

(56) References Cited

U.S. PATENT DOCUMENTS

| | | | |
|---|---|---|---|
| 2002/0100773 | A1 | 8/2002 | Rodd et al. |
| 2002/0108969 | A1 | 8/2002 | Rodd et al. |

FOREIGN PATENT DOCUMENTS

| | | | |
|---|---|---|---|
| DE | 10039408 | A1 | 12/2001 |
| DE | 10035837 | A1 | 2/2002 |

(Continued)

OTHER PUBLICATIONS

DE 10039408 translation, Oct. 2009.*

(Continued)

*Primary Examiner* — Eric Golightly

(74) *Attorney, Agent, or Firm* — James E. Howard; Andre Pallapies

(57) ABSTRACT

A household device for treating objects with a treatment agent is provided, in which the household device includes a first part of an identification system to identify data of a second part of the identification system, the data of the second part of the identification system comprising information on a dosing parameter of a dosing device, and the data of the second part of the identification system being associated with of a packaging for the dosing device, and means for adapting one of the treating of objects by the household device and a dosing the treatment agent by the dosing device based upon the identified data.

24 Claims, 3 Drawing Sheets

(51) Int. Cl.
*D06F 39/00* (2006.01)
*D06F 39/02* (2006.01)

(56) References Cited

FOREIGN PATENT DOCUMENTS

| | | | |
|---|---|---|---|
| EP | 1088927 | A1 | 4/2001 |
| GB | 2134078 | A | 8/1984 |
| WO | 0032864 | | 6/2000 |
| WO | 03029550 | A1 | 4/2003 |

OTHER PUBLICATIONS

WO 0032864 EPO machine translation, Jan. 2009.*
International Search Report PCT/EP03/13660 dated Mar. 29, 2004.

* cited by examiner

METHOD AND DEVICE FOR TREATING OBJECTS WITH AT LEAST ONE TREATMENT AGENT IN A HOUSEHOLD DEVICE, SAID HOUSEHOLD DEVICE, ASSOCIATED PACKAGING AND A DOSING DEVICE

CROSS-REFERENCE OF RELATED APPLICATIONS

This application is a Divisional, under 35 U.S.C. §121, of copending U.S. application Ser. No. 13/537,094, filed Jun. 29, 2012, now U.S. Pat. No. 8,438,882, issued on May 14, 2013, which is a Divisional, under 35 U.S.C. §121, of U.S. application Ser. No. 10/539,994, filed Jun. 17, 2005, now U.S. Pat. No. 8,268,083, issued on Sep. 18, 2012, which is a U.S. national stage application of PCT/EP2003/013660 filed Dec. 3, 2003, which designated the United States; this application also claims the priority, under 35 U.S.C. §119, of German patent application No. 102 60 144.5 filed Dec. 20, 2002.

BACKGROUND OF THE INVENTION

The invention relates to a method and an arrangement for treating objects with at least one treatment agent in a household device, a household device for treating objects with at least one treatment agent, a packaging of at least one treatment agent and a dosing device for dosing at least one treatment agent.

Various household devices for treating objects are known, such as, for example, washing machines for cleaning laundry and dishwashers for cleaning crockery, which use a plurality of cleaning agents which can be composed of various ingredients having different active parameters. That is, some of these ingredients require certain ambient conditions so that they can release their effect. Some of these ingredients cease to be effective under certain ambient conditions, such as enzymes, for example, at an ambient temperature higher than 50 degrees centigrade.

WO 01/07703 A1 discloses a device for the take up and dosed release of at least one active compound mixture in a washing machine, a dryer or a dish washer, comprising chambers for the take up of a dose of at least one active compound mixture respectively. The device also comprises an opening arrangement for the chambers, which is activated by means which in turn are activated by the conditions prevailing in the inside of the machine, which conditions prevail solely in the course of a washing, drying or dishwashing cycle.

WO 01/07704 describes a device for receiving and dispensing an active composition in a dosed manner into a washing machine, linen drier or a dishwasher, which comprises a storage chamber which receives at least double the amount of an individual dose of said active composition. This device also comprise a dosing chamber which is connected to the storage chamber by a passage in order to receive an individual dose of an active composition. A discharging passage is provided to discharge said active composition into the interior of the machine which, like the passage between the storage chamber and dosing chamber, is actuated by means which are activated by conditions inside the machine, existing exclusively during a wash, dry or dishwashing cycle.

The disadvantage of the devices described in WO 01/07703 A1 and in WO 01/07704 A1 is that the dispensing of the dose into the interior of the machine can be activated by ambient conditions, i.e. dosing parameters and/or that after the dispensing, ambient conditions may be present which are disadvantageous for the efficiency of the active composition or individual ingredients thereof or which hinder the efficiency of the active composition of individual ingredients thereof.

EP 1 088 927 A1 discloses a device for dosing and/or dispensing at least one product into an appliance for treating laundry or dishes, said device comprising at least one sensor for determining the ambient conditions. This device contains a teachable device which can identify up to three treatment programmes after a few learning runs. If one of the learned treatment programmes is executed by the device after the learning runs, the product is dispensed into the interior of the appliance at a time determined by the device.

The disadvantage of the devices described in EP 1 088 927 A1 is that the device requires a few learning runs of a treatment programme before the time at which the product is dispensed can be adapted to this treatment programme. In addition, in this device also the ambient conditions at and/or after the time at which the product is dispensed into the interior of the appliance can be disadvantageous for the efficiency of the product or of some of its ingredients.

BRIEF SUMMARY OF THE INVENTION

It is the object of the invention to improve the efficiency of treatment of objects in a household device.

This object is solved in an arrangement according to the invention of the type specified initially in that the arrangement comprises a household device for treating objects with at least one treatment agent, that the arrangement comprises a packaging for the at least one treatment agent and/or a dosing device for dosing the at least one treatment agent, that the household device comprises a first part of an identification system which makes it possible to identify data of a second part of said identification system, which comprises information on at least one treatment agent and/or on the dosing device, that the packaging and/or the dosing device comprises the second part of said identification system, and that the treatment and/or the dosing is automatically adapted to this information.

In addition, a household device of the type specified initially according to the invention is also provided to solve the object, wherein the household device comprises a first part of an identification system which is configured such that it can identify data of a second part of the identification system, which comprises information on the at least one treatment agent and/or on the dosing device for dosing the at least one treatment agent, and that the treatment and/or the dosing is automatically adapted to this information.

In addition, a packaging of the type specified initially according to the invention is provided to solve the object, said packaging being configured such that the packaging comprises a second part of an identification system which is configured such that its data can be identified by a first part of the identification system and that the data comprises information on a composition and/or active parameters of the at least one treatment agent.

Furthermore, a dosing device of the type specified initially according to the invention is provided to solve the object, said dosing device being configured such that it can be inserted into a household device for treating objects, the dosing device comprises the second part of the identification system which is configured such that its data can be identified by the first part of the identification system and that the data comprises information on the dosing device.

Finally, the object is solved in a method of the type specified initially according to the invention wherein the household device comprises a first part of an identification system which identifies data of a second part of the identification system, which comprises information on the at least one treatment agent and/or on a dosing device for dosing the at least one treatment agent, wherein a packaging for the at least one treatment agent and/or the dosing device comprises a second part of the identification system, and that the treatment and/or the dosing is automatically adapted to this information.

Since the treatment of objects in the household appliance can be adapted to information on the treatment agent used and/or to information on the dosing device used, the efficiency of the treatment is largely ensured in a simple fashion. In particular, the treatment is adapted to information on the treatment agent so that the ambient conditions in the household device during the treatment are optimal for the efficiency of the treatment agent. For this purpose it is especially advantageous if the information on the treatment agent used comprises the composition and/or the active parameters of the treatment agent.

In addition, the treatment can be adapted to information on the dosing device so that the dosing of the treatment agent can be controlled with the aid of the ambient conditions in the household device during the treatment so that the treatment is efficiently efficacious. The information on the treatment agent and/or on the dosing device can be supplied to the household device using the identification system.

If the identification system comprises especially a contact-free identification system, an advantageous further development consists in the fact that the household device with the first part of the identification system comprises a reader for transponder chips and that the packaging of the at least one treatment agent and/or the dosing device for dosing the at least one treatment agent with the second part of the identification system comprises a transponder chip.

In this way it is particularly easy to supply information from the packaging and/or from the dosing device into the household device since the data from the transponder chip can be read by the reader from a distance of about one meter.

According to an advantageous embodiment of the invention, the household device comprises a dishwasher or a washing machine. Especially for use in dishwashers or in washing machines there are a plurality of treatment agents having a wide range of compositions which require different ambient conditions for optimal efficiency. In this case, adapting the treatment to the composition of the treatment agent used quite particularly improves the efficiency of the treatment agent and thus the efficiency of the treatment.

Further features of the invention and advantageous embodiments of the invention are characterised in the dependent claims.

The efficiency of the treatment of objects in a household device is improved substantially with the present invention.

BRIEF DESCRIPTION OF THE DRAWINGS

The invention is explained subsequently with reference to the exemplary embodiment shown in the drawings. In the figures.

DETAILED DESCRIPTION OF EXEMPLARY EMBODIMENTS OF THE PRESENT INVENTION

Figure 1:
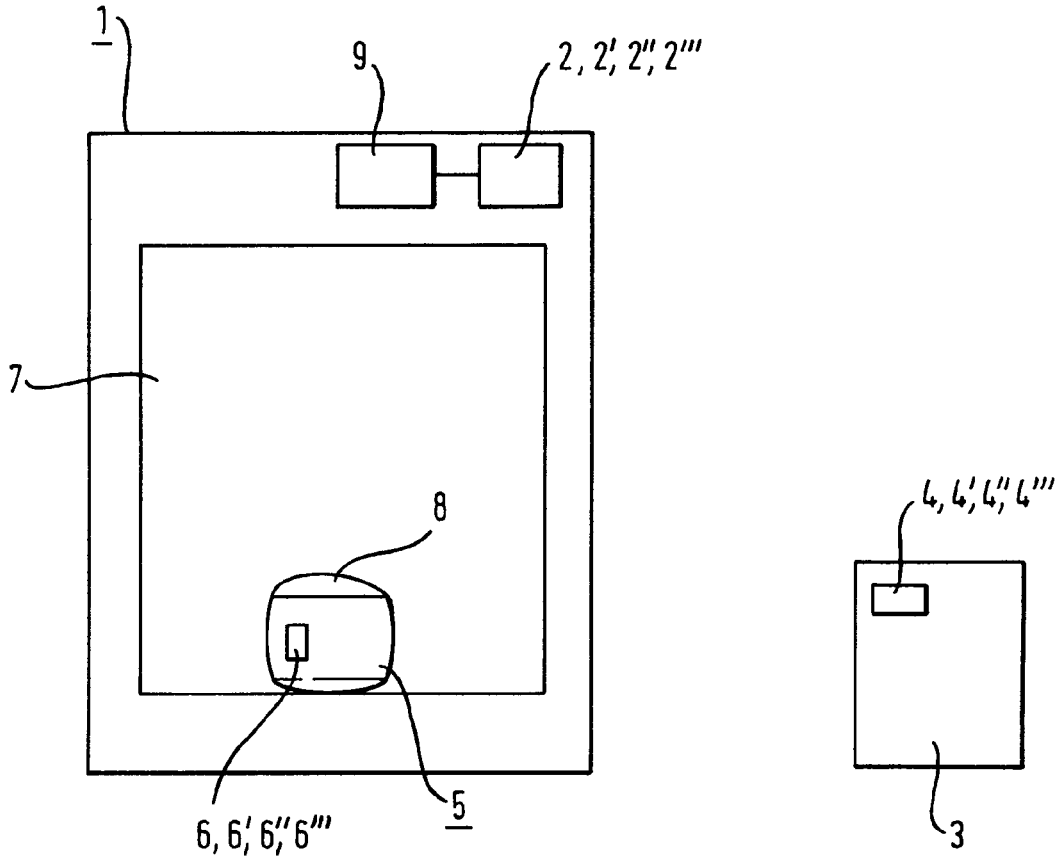
FIG. 1 is a schematic diagram of an arrangement according to the invention, comprising a household device, a packaging of a treatment agent and a dosing device according to the preferred embodiment of the invention.

The arrangement according to the preferred embodiment of the invention shown schematically in FIG. 1 consists of the household device 1, which is a dishwasher in the exemplary embodiment shown but can also alternatively be a washing machine, which comprises as a first part of an identification system a reader 2 for transponder chips, the packaging 3 of the treatment agent which as the second part of the identification system comprises a first transponder chip 4 with information on the composition and the active parameters of the treatment agent, and the dosing device 5 for dosing the treatment agent which as the second part of the identification system comprises a second transponder chip 6 with information on the type of dosing parameters of the dosing device 5.

The household device 1 has a receiving container 7 which receives objects, e.g. crockery, objects to be washed in the case of a dishwasher or laundry in the case of a washing machine, for treatment, such as cleaning for example. This receiving container 7 contains the dosing device 5 for dosing the treatment agent which comprises a dispensing device 8 which opens and thus dispenses the treatment agent when ambient conditions corresponding to the dosing parameters of the dosing device 5 prevail inside the household device during the treatment.

The household device additionally has a programme control device 9—a programme controller—which can control the treatment and which is connected to the reader 2 so that information on the treatment agent and on the dosing device 5 read out by the reader 2 is available to the programme control device 9 and said device can change the treatment such that said treatment is optimally adapted to the information.

It is especially advantageous if, as is shown in FIG. 1, information on the composition and active parameters of the treatment agent and also on the type and the dosing parameters of the dosing device 5 are available to the programme control device 9 so that the treatment can be adapted on the one hand such that the ambient conditions can attain the dosing parameters at a time which is optimal for dispensing the treatment agent inside the household device 1. On the other hand, after dispensing the treatment agent, the treatment can be adapted so that the treatment agent is optimally effective. The treatment of objects in the household device 1 is thus particularly efficacious.

In FIG. 1 a contact-free radio-based identification system comprising a reader 2 for transponder chips as a first part and transponder chips 4, 6 as a second part is shown as the identification system. In an alternative embodiment of the invention, the first part of the identification system is a chip card reader 2' and the second part of the identification system is a chip card 4', 6' which is inserted into the chip card reader 2' to identify the data. In this case, it is advantageous if the chip card 4' is loosely appended to the packaging 3 or the chip card 6' is loosely appended to the dosing device 5 so that the chip card 4' or 6' can be inserted into the chip card reader 2'.

According to a further advantageous embodiment of the invention, the identification system is an electromagnetic identification system wherein the first part is a magnetic card reader 2" and the second part is a card 4", 6" with a magnetic strip which can be inserted into the magnetic strip reader 2". In this case it is also advantageous if the card 4" is loosely appended to the packaging 3 or the chip card 6" is loosely appended to the dosing device 5 so that the card 4" or 6" with the magnetic strip can be inserted into the magnetic strip reader 2".

According to a further advantageous embodiment of the invention, the identification system is a barcode system wherein the first part is a barcode scanner 2'" and the second part is a label 4'", 6'" with a barcode which is passed by the barcode scanner 2'" to identify the information.

Figure 2:
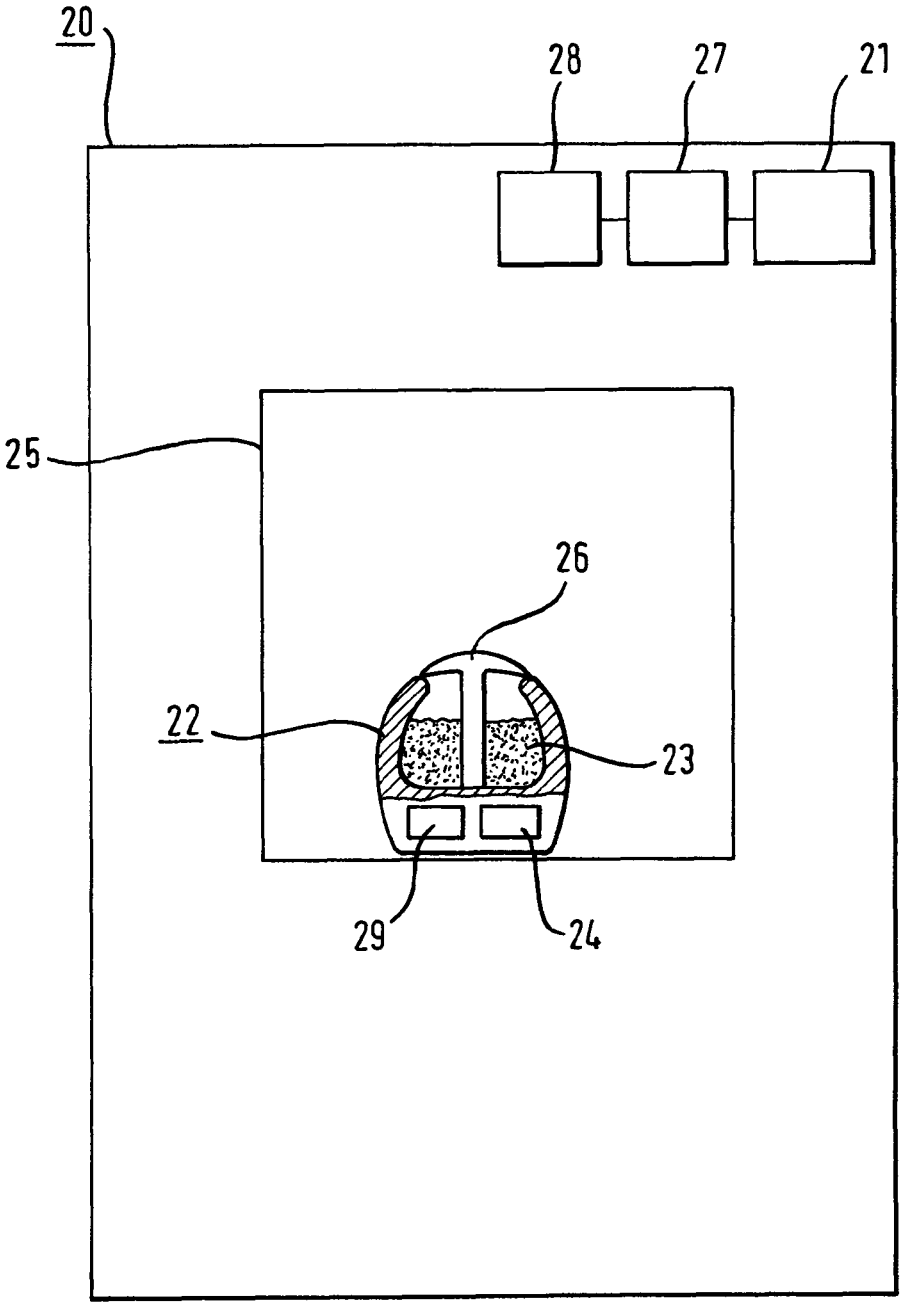
FIG. 2 is a schematic section view of an arrangement according to the invention comprising a household device and comprising a dosing device according to a further advantageous embodiment of the invention and FIG. 3 is a flow diagram of a method according to the invention for treating objects with a treatment agent in the household device using a dosing device according to the preferred embodiment from FIG. 1.

The arrangement according to a further advantageous embodiment of the invention shown in a schematic diagram in FIG. 2 comprises the household appliance 20 which is a dishwasher in the exemplary embodiment shown but alternatively can also be a washing machine, which as a first part of the identification system comprises a reader 21 for transponder chips, and comprises the dosing device 22 for actively dosing the treatment agent 23 which as the second part of the identification system comprises a transponder chip 24 with information on the type of dosing device 22.

The household device 20 has a receiving container 25 which receives objects, such as for example crockery in the case of a dishwasher or laundry in the case of a washing machine, for a treatment such as cleaning for example. This receiving container 25 contains the dosing device 22 for actively dosing the treatment agent which comprises a dispensing device 26 which can be actively opened and closed by the dosing device 22 to release the treatment agent 23 in a dosed fashion.

The household device 20 additionally has a programme control device 27—a programme controller, which controls the treatment and which is connected to the reader 21 so that the information on the type of dosing device 22 read out by the reader 21 is available to the programme control device 27. The household device 20 also has a transmitting unit 28 which is in communication with the programme control device 27 and can transmit a control signal to control the dosing of the dosing device 22.

The dosing device 22 comprises a receiving unit 29 which can receive the control signal and which is in communication with the dispensing device 26 so that the dispensing device can be opened or closed depending on the control signal received. The dosing of the treatment agent 23 can thus be controlled using the control signal. If the programme control device 27 yields information on the ingredients of the treatment agent 23, the time and quantity of the dosing can be controlled in this fashion.

It is especially advantageous if the reader 21 for transponder chips can also be used to transmit the control signal and likewise the transponder chip 24 of the dosing device 22 can receive and evaluate the control signal since the transmitting unit 28 and the receiving unit 29 can be omitted in this way.

Figure 3:
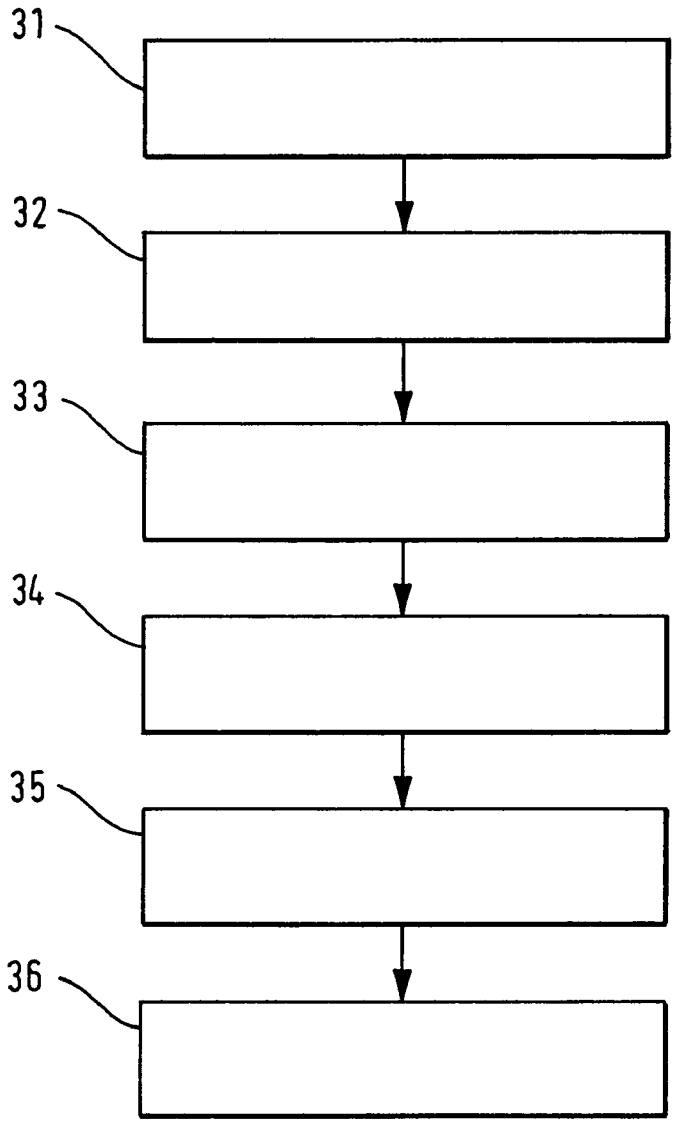

The flow diagram shown in FIG. 3 shows the individual steps involved in the treatment of objects in the household device 1 according to FIG. 1. In a first step 31 the objects for treatment are inserted in the receiving container 7 of the household device 1. In a second step 32 the user pours the treatment agent from the packaging 3 into the dosing device 5, inserts the filled dosing device 5 into the receiving container 7 and closes the household device 1. In a third step 33 the user selects a programme for the treatment and starts it.

The next steps are executed completely independently by the household device. In a fourth step 34 the data from the transponder chip 4 of the packaging 3 of the treatment agent and from the transponder chip 6 of the dosing device 5 are read out by the reader 2 and transmitted to the programme control device 9. In a fifth step 35 parameters and modules of the selected programme in the programme control device 9 are adapted to the information on the treatment agent and on the dosing device. In a last step 36 the treatment is then carried out according to the adapted programme.

The efficiency of treatment of objects in a household device 1, 20 is improved substantially with the present invention.

An exemplary embodiment is directed to an arrangement for treating objects with a treatment agent in a household device, in which the arrangement includes a household device for treating objects with the treatment agent, a packaging for a dosing device for dosing the treatment agent, a first part of an identification system that identifies data of a second part of the identification system, the data of the second part of the identification system comprising information on the dosing device, and the data of the second part of the identification system being associated with a packaging for the dosing device, and means for adapting one of the treatment of objects by the household device and the dosing of the treatment agent based upon the identified data.

What is claimed is:

1. A household device for treating objects with a treatment agent, the household device comprising:

an identification system configured to identify data on a dosing parameter of a dosing device; and a program controller programmed with instructions wherein the instructions, when executed, cause the household device to perform program steps of:

operating the identification system to identify the data on the dosing parameter of the dosing device operable to dose the treatment agent, the identified data being associated with a packaging for the dosing device; and adapting one of the treating the objects by the household device and a dosing the treatment agent by the dosing device based upon the identified data.

2. The household device of claim 1, wherein the household device comprises one of a dishwasher and a washing machine.

3. The household device of claim 1, further comprising:

the dosing device configured to dispense the treatment agent;

a first readable memory configured to store first data regarding one of a composition of the treatment agent and an active parameter for the treatment agent;

a second readable memory configured to store second data regarding the dosing device; and a reader configured to communicate with the first readable memory and the second readable memory, wherein the program controller is programmed to control the treating the objects to optimize ambient conditions for dispensing the treatment agent from the dosing device at a predetermined time based upon the first data and the second data.

4. The device of claim 3, wherein the program controller is programmed to control the treating the objects after the dosing device dispenses the treatment agent to optimize an effectiveness of the treatment agent based upon the first data and the second data.

5. The household device of claim 1, further comprising:

the dosing device configured to dispense the treatment agent;

a first readable memory configured to store first data regarding one of a composition for the treatment agent and an active parameter for the treatment agent;

a second readable memory configured to store second data regarding the dosing device; and a reader configured to communicate with the first readable memory and the second readable memory, wherein the program controller is programmed to control a time of dispensing of the treatment agent from the dosing device during the treating the objects to optimize an effectiveness of the treatment agent based upon the first data and the second data.

6. The household device of claim 1, wherein the program controller is operable to control a time parameter and a quantity parameter of the dosing of the treatment agent based upon the identified data.

7. The household device of claim 1, wherein the treatment agent comprises one of a dishwashing treatment agent and a washing machine treatment agent.

8. The household device of claim 1, further comprising:

a reader configured to communicate with a readable memory storing data regarding one of a composition of the treatment agent, an active parameter for the treatment agent, and the identified data of the identification system, wherein the program controller is configured to communicate with the reader and the dosing device, the program controller programmed to control the treating the objects to optimize ambient conditions for dispensing the treatment agent from the dosing device at a predetermined time based upon the identified data of the identification system.

9. The arrangement of claim 8, wherein the program controller is programmed to control the treating the objects after the dosing device dispenses the treatment agent to optimize an effectiveness of the treatment agent based upon the identified data of the identification system.

10. The household device of claim 1, further comprising:

a reader configured to communicate with a readable memory, wherein the program controller is programmed to control the treating the objects to optimize ambient conditions for dispensing the treatment agent from the dosing device at a predetermined time based upon the identified data of the identification system.

11. The household device of claim 10, wherein the program controller is programmed to control a time parameter and a quantity parameter of the dosing the treatment agent based upon the identified data.

12. The household device of claim 1, further comprising:

a dispenser configured to dose the treatment agent; and a transmitting unit configured to transmit a control signal to a receiving unit of the dispenser.

13. The household device of claim 1, wherein the identification system comprises a non-contact identification system.

14. The household device of claim 1, wherein the identification system comprises a barcode system, wherein the household device includes a barcode scanner configured to read a barcode.

15. The household device of claim 1, wherein the identification system comprises a radio-based identification system.

16. The household device of claim 1, wherein the household device comprises a transponder chip reader configured to read a transponder chip.

17. The household device of claim 1, further comprising a chip card reader configured to read a chip card that can be inserted into the chip card reader for identification of data carried on the chip card by the chip card reader.

18. The household device of claim 1, wherein the identification system comprises an electronic identification system having a magnetic strip reader configured to read a magnetic strip.

19. The household device of claim 1, wherein the adapting one of the treating the objects by the household device and the dosing the treatment agent by the dosing device comprises adapting parameters of a treatment control program to the identified data.

20. The household device of claim 1, wherein the identified data includes information concerning dosing parameters of the dosing device.

21. The household device of claim 1, further comprising:

a receiving container for treating the objects, wherein the program controller is programmed to operate the identification system to identify the data on the dosing parameter of the dosing device when the dosing device is disposed inside the receiving container.

22. A household device for treating objects with a treatment agent, the household device comprising:

an identification system configured to identify data on a dosing parameter of a dosing device; and means for operating a first part of the identification system to identify the data of a second part of the identification system, the identified data of the second part of the identification system comprising information on the dosing device operable to dose the treatment agent, and the identified data of the second part of the identification system being associated with the packaging for the dosing device, and for adapting one of the treating the objects by the household device and a dosing the treatment agent by the dosing device based upon the identified data of the second part of the identification system.

23. The household device of claim 22, wherein the adapting one of the treating the objects by the household device and the dosing the treatment agent by the dosing device comprises adapting parameters of a treatment control program to the identified data of the second part of the identification system.

24. The household device of claim 22, further comprising:

a receiving container for treating the objects, wherein the means for operating and adapting operates the first part of the identification system to identify the data of the second part of the identification system when the dosing device is disposed inside the receiving container.

* * * * *